United States Patent [19]

Salmon et al.

[11] Patent Number: 5,069,367

[45] Date of Patent: Dec. 3, 1991

[54] POURING STOPPER WITH TEAR-OFF GUARANTEE STRIP WITH A SEPARATE DIAPHRAGM

[75] Inventors: Pierre Salmon, Châtillon d'Azergues; Claude Pradinas, Couzon-au-Mont d'Or, both of France

[73] Assignee: Societe Nouvelle de Bouchons Plastiques, Anse, France

[21] Appl. No.: 549,936

[22] Filed: Jul. 9, 1990

[30] Foreign Application Priority Data

Jul. 12, 1989 [FR] France ..... 89 09673

[51] Int. Cl.[5] ..... B67B 5/00

[52] U.S. Cl. ..... 222/153; 215/254; 215/306; 215/346; 220/259; 222/541; 222/556

[58] Field of Search ..... 222/498, 541, 545, 546, 222/556, 153; 215/254, 256, 306, 349, 350; 220/259

[56] References Cited

U.S. PATENT DOCUMENTS 4,171,749 10/1979 Obrist et al. ..... 222/541 X
4,592,480 6/1986 Hart et al. ..... 222/541 X
4,711,380 12/1987 Ulm ..... 222/541
4,778,071 10/1988 Fillmore ..... 222/498 X
4,796,769 1/1989 Obadia ..... 222/541 X
4,901,892 2/1990 Song ..... 222/541 X
4,941,592 7/1990 Kitterman ..... 222/541 X

FOREIGN PATENT DOCUMENTS 0210138 1/1987 European Pat. Off. ..... 222/153

*Primary Examiner*—Donald T. Hajec
*Assistant Examiner*—Joseph A. Kaufman
*Attorney, Agent, or Firm*—Dowell & Dowell

[57] ABSTRACT

A stopper for a dispensing container having a body portion from which a pour spout extends, which spout is closed by a cap and wherein the stopper further includes a diaphragm member for surrounding the spout and sealing the body portion thereof and which diaphragm also includes a vertically extending band having a slot therein for receiving a locking flange extending from the cap with the band being severable from the diaphragm upon opening of the cap to thereby provide a guarantee strip to indicate opening of the stopper.

5 Claims, 2 Drawing Sheets

POURING STOPPER WITH TEAR-OFF GUARANTEE STRIP WITH A SEPARATE DIAPHRAGM

BACKGROUND OF THE INVENTION

1. Field of the Invention

The present invention relates to a pouring stopper made in one piece and including a body selectively mounted to the neck of a dispensing container and a cap articulated on the body.

2. History of the Related Art

In devices of the type in question, the body is frequently hollow around a pouring spout, with the result that its inner lower part may be soiled during use. Moreover, pouring stoppers of the type in question generally do not comprise a tear-off guarantee or tamper strip, indicating thus there is no guarantee for the consumer as to the authenticity of the product contained in the receptacle.

It is an object of the present invention to remedy these drawbacks and to produce a pouring stopper wherein the hollow body is closed by a diaphragm which extends outwardly to form a tear-off guarantee strip.

SUMMARY OF THE INVENTION

According to the invention, a diaphragm is joined to the upper part of the body and surrounds the pouring member. The diaphragm includes a guarantee strip which is seated against the outside of the cap and includes a slot which is traversed by a flange for maneuvering the cap. The strip is joined to the diaphragm by a zone of lesser material resistance so that the band is broken upon the opening of the cap.

In order to ensure a better seal of the diaphragm with respect to the bottom of the hollow body, the periphery of the diaphragm may be welded to the corresponding part of the body.

In order to clearly show the presence of the tear-off guarantee strip, the diaphragm/guarantee strip assembly may be colored differently from the pouring stopper.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
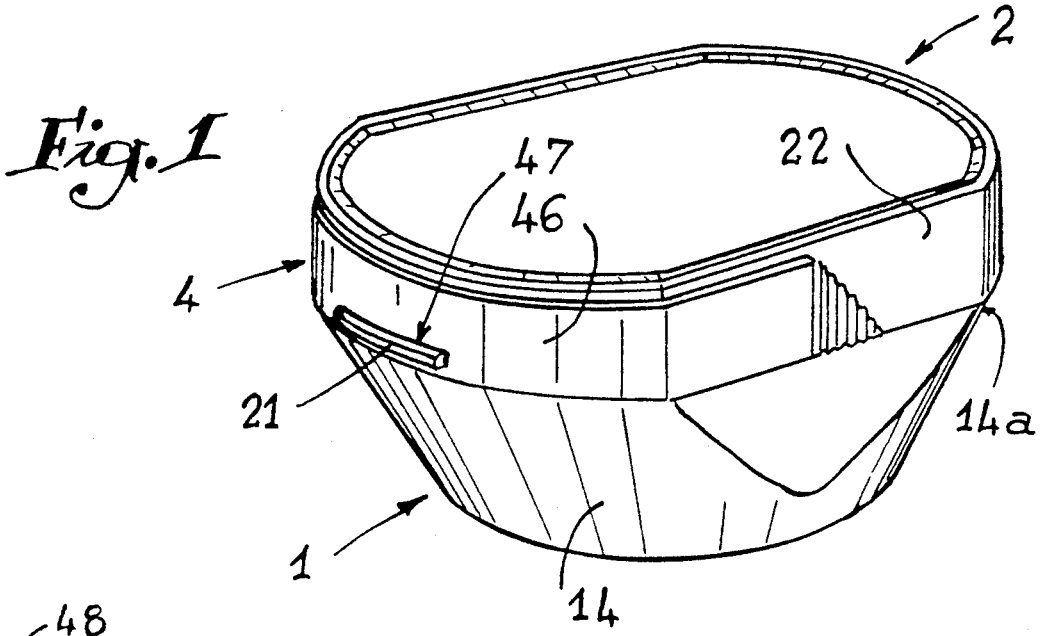
FIG. 1 is a view in perspective of a pouring stopper incorporating the improvements according to the invention.
Figure 2:
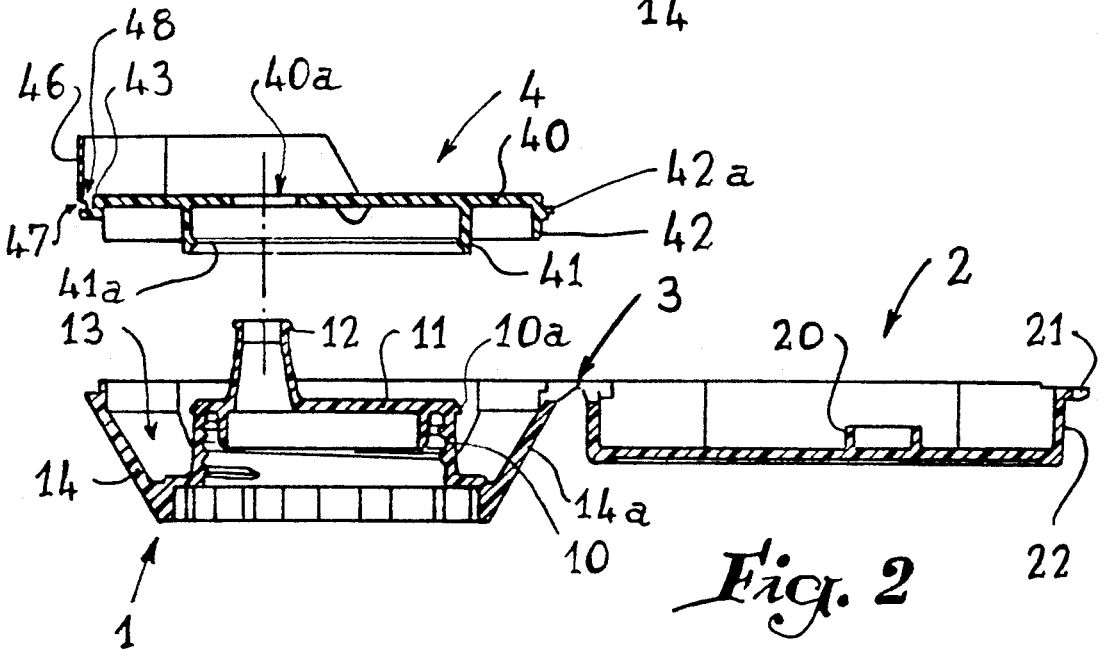
FIG. 2 is a transverse section through the different elements of the pouring stopper according to the invention, shown separated.

Referring now to the drawings, and firstly to FIGS. 1 and 2, the pouring stopper comprises a body 1 adapted to be associated with the neck of a dispensing container or receptacle (not shown) and a cap 2. The cap and body are preferably made in one piece and are joined by a hinge 3 as is well known in the art. The assembly presents an outer configuration which is oblong having two rounded ends joined by two rectilinear panels.

The body 1 is provided with a central tubular sleeve 10 whose inner face includes a thread adapted to cooperate with that of the neck of the dispenser. This sleeve is closed, by an upper transverse wall 11 from which extends a tubular pouring spout 12. This structure leads to the formation of an annular hollow space 13 surrounding the spout 12 and into which some of the product poured thereby may be deposited and constitute an undesirable deposit especially when the product stored in the container is edible matter.

Figure 3:
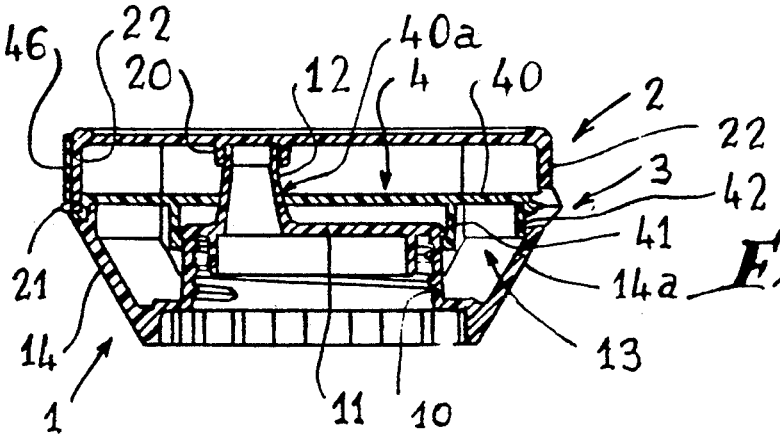
FIG. 3 is a transverse section through the pouring stopper illustrated in FIG. 1.

It will be observed that the interior of the cap 2 is provided with a hollow boss 20 adapted to close the end of the tubular pouring spout 12 when the cap is closed, as illustrated in FIG. 3.

The invention provides structure for closing space 13 at the level of the free edge of the skirt 14 of body 1 by a diaphragm 4. The diaphragm includes a plate 40 which is flat and of a configuration identical to the inner shape of the skirt 14 at the level of its free edge. Plate 40 includes an opening 40*a* which hermetically surrounds the base of the pouring spout 12. The lower face of the plate 40 is integral with a tubular sleeve 41 whose inner face is provided with an annular bead 41*a* adapted to clip beneath a peripheral rib 10*a* provided on the outside of sleeve 10.

Figure 4:
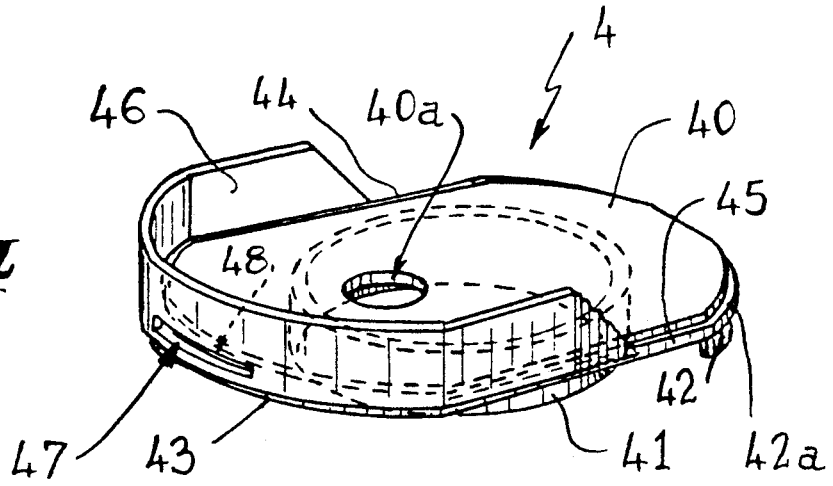
FIG. 4 is a view in perspective of the diaphragm illustrated in section in FIG. 2.
Figure 5:
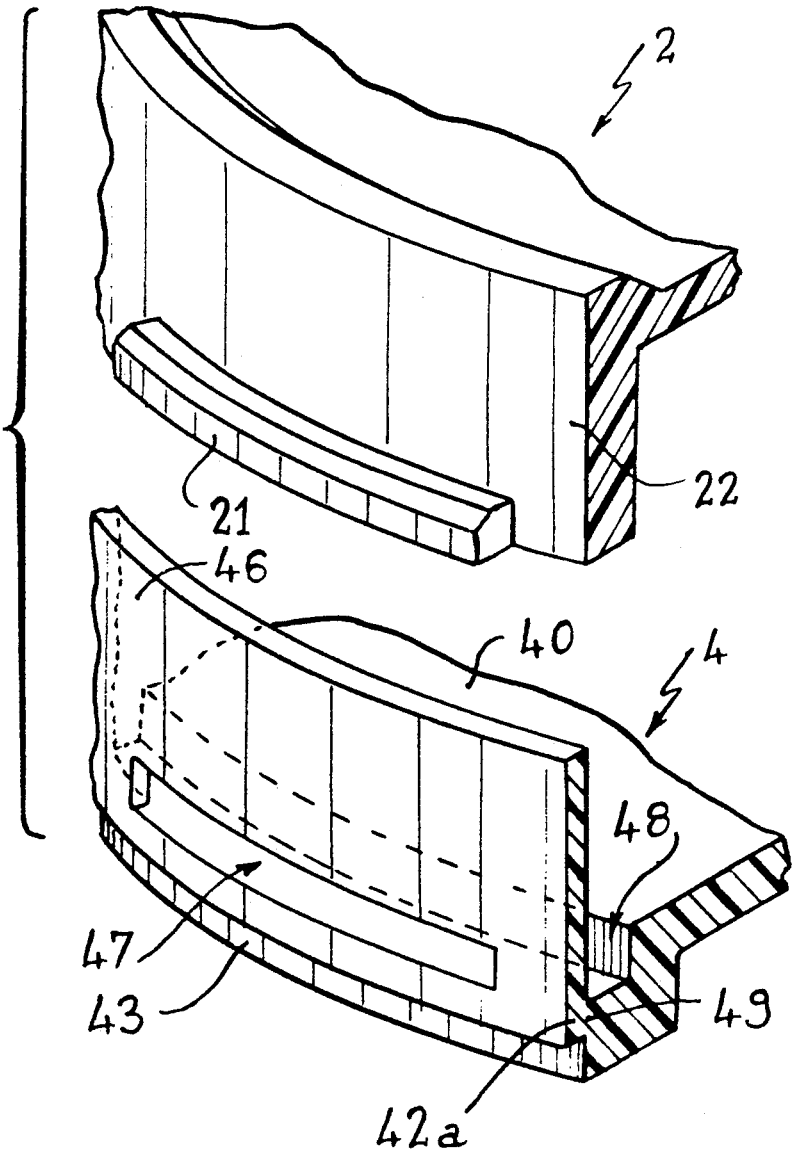
FIG. 5 is a partial exploded view on a larger scale showing those parts of the diaphragm 4 and of the cap 2 which are locked with respect to one another.

The side of the plate 40 intended to cooperate with that part of the skirt 14 disposed in the vicinity of hinge 3 comprises a blade 42 whose free edge cooperates with the interior of the rounded part 14*a* of the skirt 14 located in the vicinity of the hinge. It is observed that an outwardly facing molding 42*a* which rests on the free edge of the skirt 14 is associated with the blade 42. This molding is interrupted at the hinge 3 and extends over the whole periphery of plate 40 (FIGS. 4 and 5).

The rounded edge 43 of the plate 40 opposite the blade 42 as well as part of the two rectilinear sides 44, 45 of the plate (FIG. 4) are associated with a vertical band 46 having a horizontal slot 47 located on either side of the plane of symmetry of the plate 40. The periphery of the plate has a groove 48 made therein (FIG. 5) into which opens slot 47. Band 46 is thus joined to the edge of the plate by a zone of lesser material resistance 49. It will be noted that the two ends of the band 46 are oblique and includes vertical ribs.

Diaphragm 4 may, of course, be joined to body 1 in any other manner and in particular by welding the molding 42*a* with respect to the skirt 14 of body 1. Once diaphragm 4 is joined to the latter, the cap 2 is closed by pivoting it about hinge 3, so that a peripheral projection or flange 21 of the cap 2 engages in slot 47, with the result that any opening of the body brings about destruction or separation of the band 46 from the plate 40.

It will be observed that the cap includes an annular partition 22 against a part of which rests the band 46 provided for example to be of the same height as said partition. As indicated in the preamble, the diaphragm 4 may advantageously be made in a color different from that of the pouring stopper.

It must, moreover, be understood that the foregoing description has been given only by way of example and that it in no way limits the domain of the invention which would not be exceeded by replacing the details of execution described by any other equivalents.

What is claimed is:

1. In a pouring stopper for a dispensing container wherein the stopper includes a hollow body and a cap which are jointed by a hinge, the improvement comprising, said body having a central threaded tubular member, a peripheral skirt which extends upward relative to the threaded central tubular member, said skirt having an upper edge, said tubular member being closed by an upper transverse wall from which extends a tubular pouring spout, an annular recess formed between said tubular member and said skirt, a diaphragm separate from the body and mechanically coupled to the body having a generally planar portion hermetically engaging said upper edge of said skirt and covering said annular recess, said planar portion including an opening which hermetically surrounds said pouring spout, said diaphragm having a guarantee band extending vertically from said planar portion and being connected thereto by a zone of lesser resistance, a slot through said band, said cap including an outwardly extending flange, said flange being seated within said slot when said cap is closed relative to said body and said band being separated from said planar portion of said diaphragm at said zone of lesser resistance upon the opening of said cap relative to said body.

2. The pouring stopper of claim 1 including an annular sleeve extending downwardly with respect to said planar portion of said diaphragm, said annular sleeve being engageable in surrounding relationship with respect to said central tubular member.

3. The pouring stopper of claim 1 including an annular groove formed between said planar portion of said diaphragm and said guarantee band, said slot being oriented so as to open into said groove.

4. The pouring stopper of claim 1 wherein said diaphragm is frictionally secured with respect to said body.

5. The pouring stopper of claim 1 in which said diaphragm is welded to said body.

* * * * *